US009428890B2

(12) United States Patent
Lu

(10) Patent No.: US 9,428,890 B2
(45) Date of Patent: Aug. 30, 2016

(54) WATER OUTLET STRUCTURE OF A DUAL-CONNECTED FAUCET INNER CORE

(71) Applicant: PPI XIAMEN INDUSTRY CO., LTD., Xiamen (CN)

(72) Inventor: Wenrong Lu, Xiamen (CN)

(73) Assignee: PPI XIAMEN INDUSTRY CO., LTD., Xiamen, Fujian (CN)

( * ) Notice: Subject to any disclaimer, the term of this patent is extended or adjusted under 35 U.S.C. 154(b) by 109 days.

(21) Appl. No.: 14/474,096

(22) Filed: Aug. 30, 2014

(65) Prior Publication Data

US 2016/0060851 A1 Mar. 3, 2016

(51) Int. Cl.

| | |
|---|---|
| ***E03C 1/00*** | (2006.01) |
| ***E03C 1/04*** | (2006.01) |
| ***E03C 1/02*** | (2006.01) |

(52) U.S. Cl.

CPC ..... *E03C 1/0403* (2013.01); *E03C 1/021* (2013.01); *Y10T 137/598* (2015.04); *Y10T 137/9464* (2015.04)

(58) Field of Classification Search

CPC .. E03C 1/0401; E03C 1/0402; E03C 1/0403; E03C 2001/0416; Y10T 137/598; Y10T 137/6014; Y10T 137/9464; F16K 19/006

See application file for complete search history.

(56) References Cited

U.S. PATENT DOCUMENTS

| | | | | |
|---|---|---|---|---|
| 8,667,625 | B2 * | 3/2014 | Chang | E03C 1/0404 4/695 |
| 8,684,025 | B2 * | 4/2014 | Dai | F16K 19/006 137/315.12 |
| 8,746,273 | B2 * | 6/2014 | Yang | E03C 1/0401 137/315.12 |
| 8,931,500 | B2 * | 1/2015 | Thomas | E03C 1/04 137/15.18 |
| 2011/0186146 | A1 * | 8/2011 | Guan | F16K 43/00 137/315.01 |
| 2013/0181440 | A1 * | 7/2013 | Dai | F16K 19/006 285/124.2 |

FOREIGN PATENT DOCUMENTS

| | | | |
|---|---|---|---|
| WO | WO 03089817 A2 * | 10/2003 | E03C 1/0401 |

* cited by examiner

*Primary Examiner* — Jessica Cahill

(57) ABSTRACT

A water outlet structure of a dual-connected faucet inner core comprises a faucet inner core body, multiple metal conduits integrally formed on two water inlet pipes of the faucet inner core body, and an adapter movably connected to the water outlet of the faucet inner core body. The configuration of the subject dual-connected faucet inner core body can fit in with different shapes of faucet housings by different adapters, thereby decreasing the manufacturing cost effectively and enhancing the market competitiveness of the product.

7 Claims, 7 Drawing Sheets

WATER OUTLET STRUCTURE OF A DUAL-CONNECTED FAUCET INNER CORE

BACKGROUND OF THE INVENTION

1. Field of the Invention

The present invention relates to a faucet structure applied to bathrooms or kitchens, especially to a water outlet structure of a dual-connected faucet inner core which connects cold and hot water pipes simultaneously.

2. Description of the Related Art

The dual-connected faucet structure is a valve which connects cold and hot water pipes at the same time. The common dual-connected faucet inner core is normally formed by plastic or completely formed by metallic copper pipes. During the installation, two water inlets of the faucet inner core are rotatably screwed to the cold water pipe or the hot water pipe. A certain torque to assure of sealing the screwed portion is required. However, when the plastic-formed faucet inner core body is screwed with the pipes, the sealing condition is affected due to wear of threads and a release caused by insufficient torque. Another metallic copper-tube faucet inner core body may overcome the drawback of the torque, but the minor elements like zinc or lead in the copper pipes will lose along with the water in a long term of use, which leads to healthy problems of people in the long-term drink of the abovementioned water. If the structure is completely formed by metallic copper material, more manufacturing costs are needed.

Therefore, a dual-connected faucet inner core structure which assures the strong connection strength and healthy water is developed and formed by a plastic-formed faucet inner core body coupled with metal conduits which are connected to cold and hot water pipes. The faucet body comprises a cold water inlet pipe, a hot water inlet pipe and a transverse pipe communicating with the cold and hot water inlet pipes for forming an H-shaped construction. The metal conduits are respectively formed on outer walls of the cold water inlet pipe and the hot water inlet pipe, and a water outlet is formed on the transverse pipe. To fit in with faucet housings in different shapes, the water outlet must to be formed in accordance with the shapes of the desired faucets. Generally, different shapes of faucets need particular inner cores, which may lead to high costs of molds.

SUMMARY OF THE INVENTION

Accordingly, the object of the present invention is to provide a water outlet structure of a dual-connected faucet inner core for reducing the manufacturing cost. Forming one shape of the dual-connected faucet inner core can be applied to faucet housings in different shapes.

For achieving the abovementioned objects, the solution of the present invention is:

A water outlet structure of a dual-connected faucet inner core comprises a faucet inner core body and multiple metal conduits integrally formed on two water inlet pipes of the faucet inner core body; wherein an adapter is disposed to be movably connected to a water outlet of the faucet inner core body. A water outlet portion is formed at a middle of the adapter and disposed correspondingly to a direction of a water outlet mouth of a faucet housing. A connecting portion which extends into the water outlet of the faucet inner core body is formed at an underside of the water outlet portion. A connecting structure is disposed beside the water outlet of the faucet inner core body for fitting in with the adapter. A cooperating structure which is connected to the connecting structure is disposed on the adapter.

Preferably, the faucet inner core body is integrally formed by plastic, which comprises an H-shaped configuration formed by a cold water inlet pipe, a hot water inlet pipe and a transverse pipe communicating with the cold water inlet pipe and the hot water inlet pipe. The water outlet is disposed on the transverse pipe.

Preferably, the transverse pipe further comprises an inner-core transverse pipe disposed therein. The inner-core transverse pipe disposes the water outlet mouth corresponding to the water outlet of the transverse pipe. Two ends of the inner-core transverse pipe are defined by expanding portions that communicate with the cold water inlet pipe and the hot water inlet pipe respectively.

Preferably, each of the metal conduits is a sleeve with external threads formed on an outer periphery thereof, and a set of convexities or concavities is axially distributed on an inner periphery thereof.

Preferably, a set of through holes is distributed at an upper portion of each of the metal conduits.

Preferably, the connecting structure is formed by two upward-protruding hooks which are symmetrically formed on two sides of the water outlet, and the cooperating structure corresponding to the adapter is formed by a connecting plate that is formed on a top-side edge of the connecting portion of the adapter. A front width of the connecting plate is corresponding to a width between hook bottoms of the two hooks. A side width thereof is smaller than the width between the hook bottoms of the two hooks. A thickness of the connecting plate is smaller than a height from the hook bottoms to hook tops of the two hooks.

Preferably, a recess is formed on a top surface of the transverse pipe at an inner side of one of the hooks or the two hooks, and a fixing convex unit corresponding to the recess is formed on a bottom surface of the connecting plate.

Preferably, a set of first locking holes is formed on the cooperating structure, and a set of second locking holes is formed on the corresponding transverse pipe. The adapter and the faucet inner core body are installed in place and fastened with each other by a fastener.

After adopting the aforesaid solutions, the present invention takes advantage of the connecting structure disposed beside the water outlet of the faucet inner core body to set the water outlet cooperating with the water outlet mouth of different faucet housing in various shapes into adapters in different shapes and dispose the cooperating structure connected to the connecting structure on the adapter, whereby the adapter and the faucet inner core body are assembled to construct the double-faucet structure in a variety of shapes. The subject invention achieves a dual-connected faucet inner core body in one shape to fit in with faucet housings in a variety of shapes by using different adapters, thereby lowering the manufacturing cost effectively and enhancing the market competitiveness of the product.

DETAILED DESCRIPTION OF THE PREFERRED EMBODIMENTS

Figure 1:
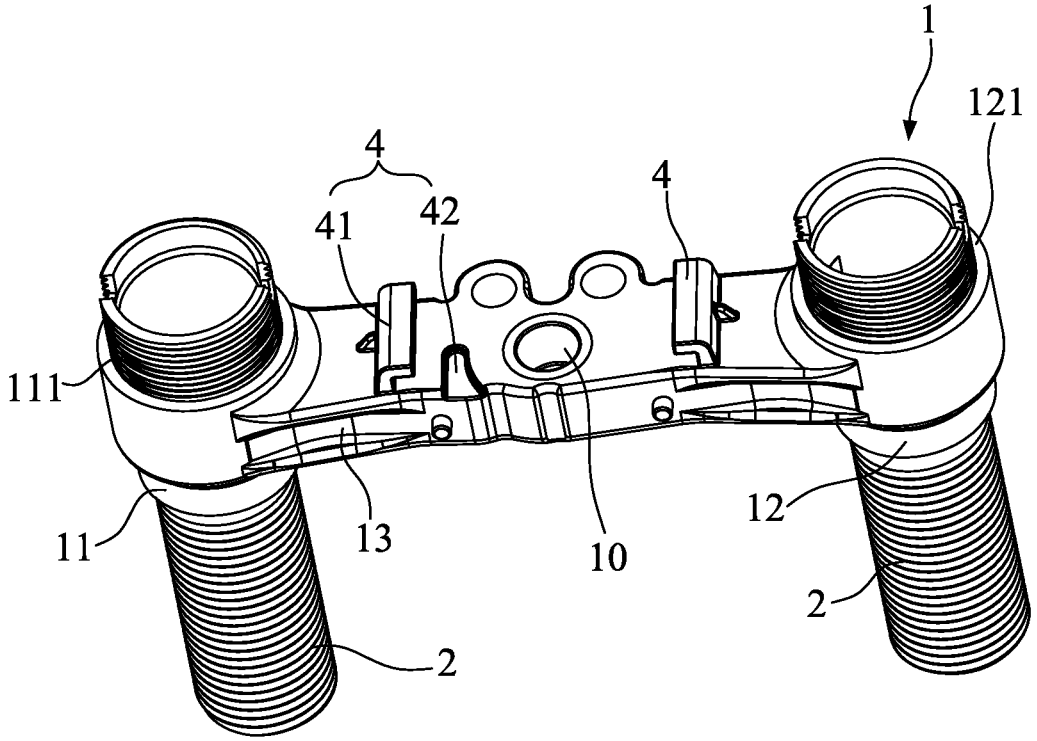
FIG. 1 is a schematic view showing a structure of a dual-connected faucet inner core body of the present invention.

The present invention is described in conjunction with the accompanying figures:

As shown from FIGS. 1 to 9, the present invention discloses a water outlet structure of a dual-connected faucet inner core, which comprises a faucet inner core body 1 and multiple metal conduits 2 integrally formed on two water inlet pipes of the faucet inner core body 1; wherein the present invention further comprises an adapter 3 movably connected to a water outlet of the faucet inner core body 1. A water outlet portion 31 corresponding to a water outlet mouth of a faucet housing is formed at a middle of the adapter 3, and a connecting portion 32 extending into the water outlet of the faucet inner core body 1 is formed at an underside of the water outlet portion 31. A connecting structure 4 is disposed beside the water outlet 10 of the faucet inner core body 1 for fitting in with the adapter 3, and a cooperating structure 5 connected to the connecting structure 4 is disposed on the adapter 3.

Figure 2:
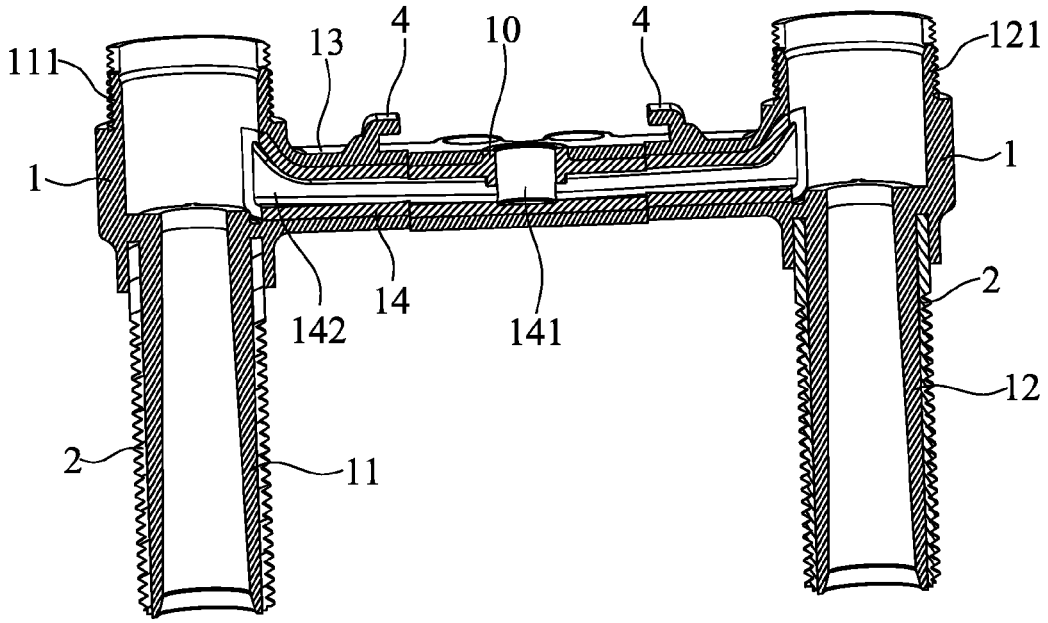
FIG. 2 is a cross-sectional view of the dual-connected faucet inner core body of the present invention.
Figure 3:
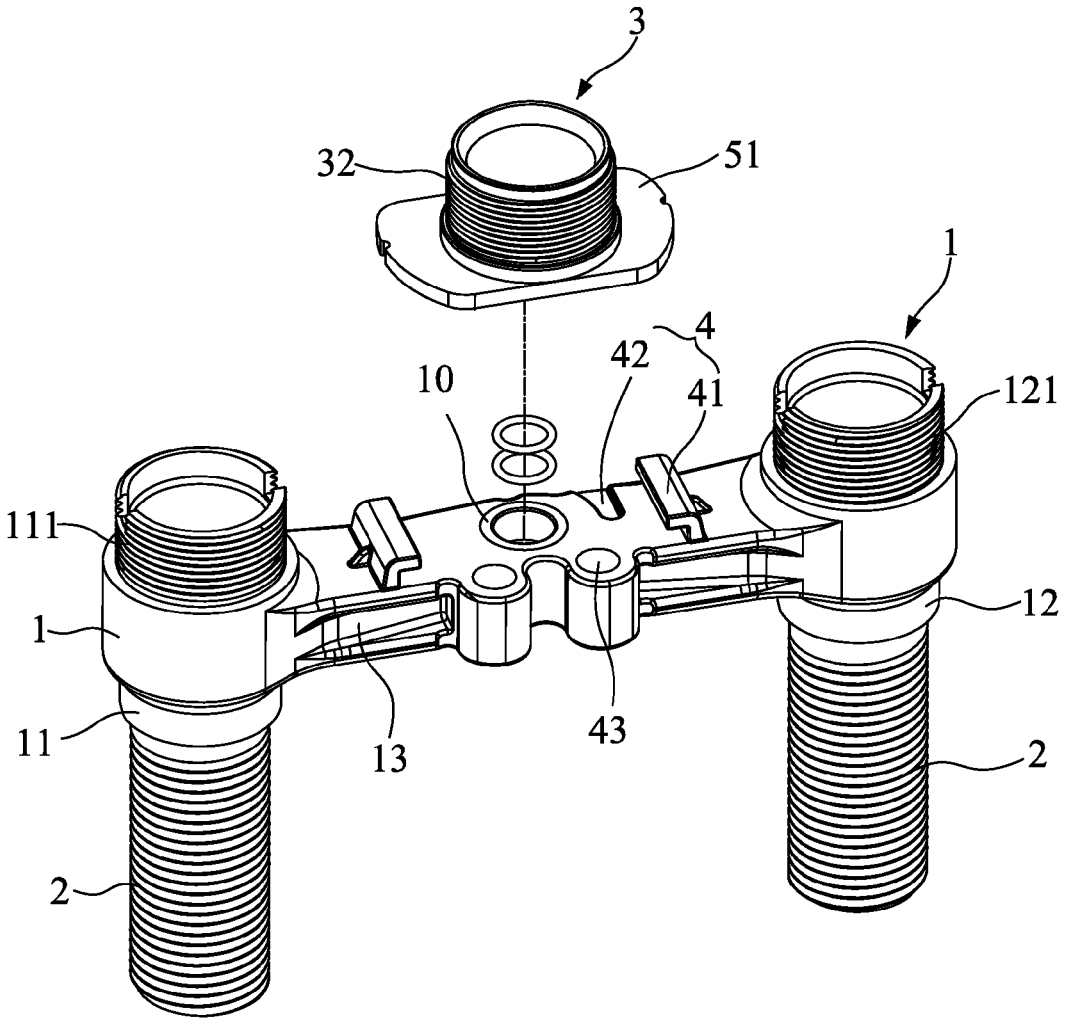
FIG. 3 is an exploded view showing the dual-connected faucet inner core body and the adapter.

Referring to FIGS. 1 and 2, the faucet inner core body 1 is integrally formed by plastic and comprises an H-shaped structure formed by a cold water inlet pipe 11, a hot water inlet pipe 12 and a transverse pipe 13 communicating with the cold water inlet pipe 11 and the hot water inlet pipe 12. The water outlet 10 is disposed on the transverse pipe 13.

The transverse pipe 13 further comprises an inner-core transverse pipe 14 formed therein. The inner-core transverse pipe 14 has a water outlet mouth 141 disposed correspondingly to the water outlet 10 of the transverse pipe 13. Two ends of the inner-core transverse pipe 14 are defined by expanding portions 142 that communicate with the cold water inlet pipe 11 and the hot water inlet pipe 12 respectively. The expanding portions 142 are formed in a flared or a quasi-funneled shape, whereby a flow area from the water inlet pipes to the inner-core transverse pipe 14 is increased for assuring the faucet of meeting the standard of water outlet.

Each of the metal conduits 2 is a sleeve with exterior threads formed on an outer periphery thereof, and convexities 21 or concavities are axially formed on an inner periphery thereof. The convexities 21 or the concavities are formed for enhancing the combining strength between outer walls of the cold water inlet pipe 11 and the hot water inlet pipe 12 of the integral-formed faucet body 1 and the metal conduits. Each of the metal conduits 2 can have through holes formed on an upper portion thereof and filled with plastic to attain an enhanced and stable connection with the cold water inlet pipe 11 and the hot water inlet pipe 12. The metal conduits 2 can be formed by copper material.

The dual-connected faucet inner core of the present invention is formed by placing the shaped inner-core transverse pipe 14 and two metal conduits 2 into a mold of the faucet body 1 and adopting an injection molding process to form a dual-connected faucet inner core integrally with the cold water inlet pipe 11 and the hot water inlet pipe 12 whose outer walls are coupled with the metal conduits 2 and the transverse pipe 13 which wraps the inner-core transverse 14. Valve seats 111, 121 are concurrently formed on tops of the cold water inlet pipe 11 and the hot water inlet pipe 12. The water outlet 10 of the transverse pipe 13 is a smooth mouth.

The connecting structure 4 can be formed by two upward-protruding hooks 41 symmetrically formed on two sides of the water outlet 10. An inner side of one of the hooks 41 or two hooks 41 can form a recess 42 on a top surface of the transverse pipe 13. The cooperating structure 5 corresponding to the adapter 3 is defined by a connecting plate 51 that is formed on a top-side edge of the connecting portion 32 of the adapter 3. A front width of the connecting plate 51, namely the width for installing in place, is corresponding to a width between the hook bottoms of the two hooks 41, and a side width thereof is smaller than the width of the hook bottoms of the two hooks 41. A thickness of the connecting plate 51 is smaller than a height from the hook bottoms to hook tops of the two hooks 41. A fixing convex unit 52 corresponding to the recess 42 is formed on a bottom surface of the connecting plate 51.

Figure 4:
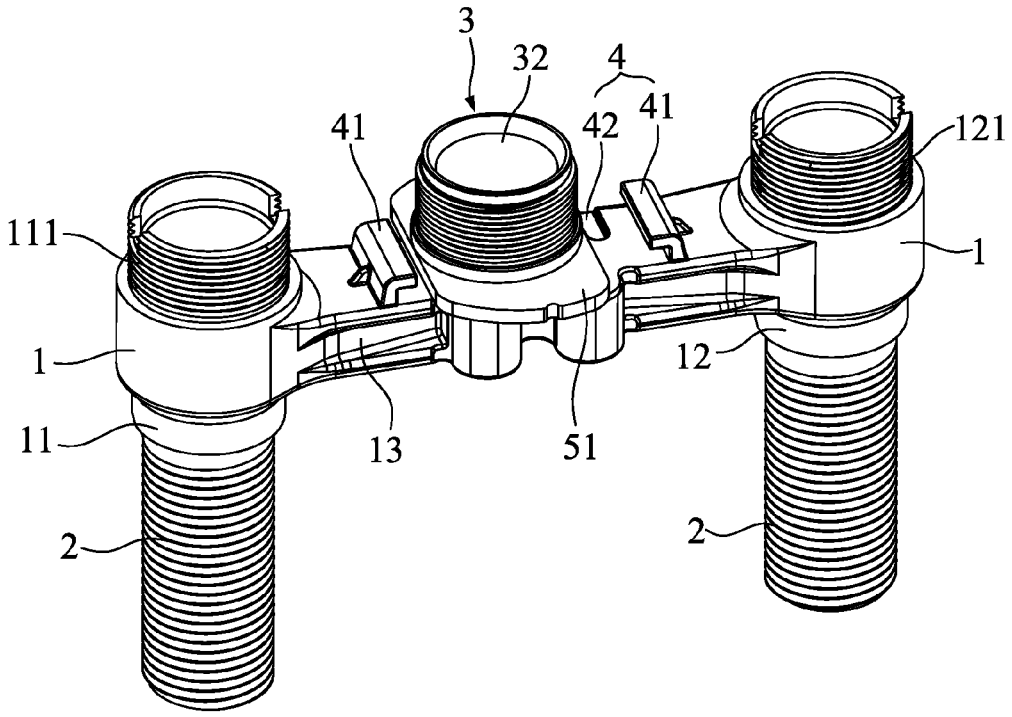
FIG. 4 is a schematic view showing the operation of making the dual-connected faucet inner core body fit in with the adapter.
Figure 5:
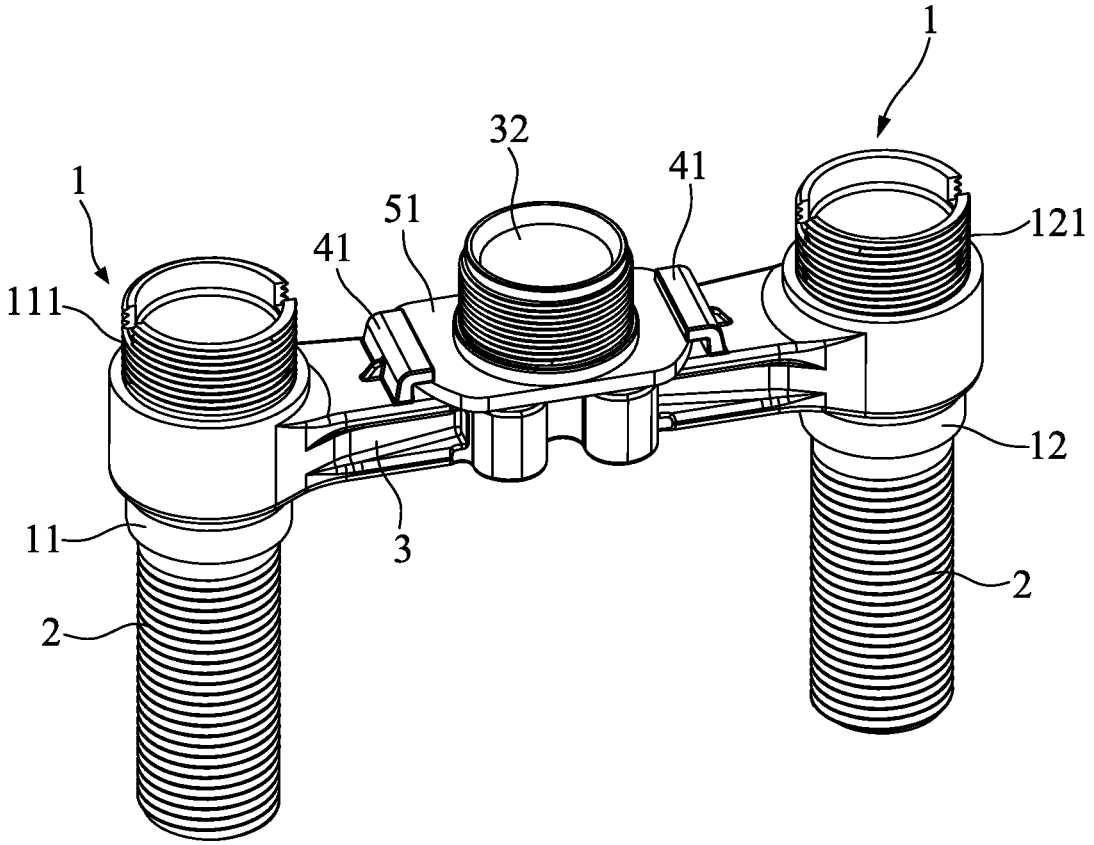
FIG. 5 is a schematic view showing the combination of the dual-connected faucet inner core body and the adapter.
Figure 6:
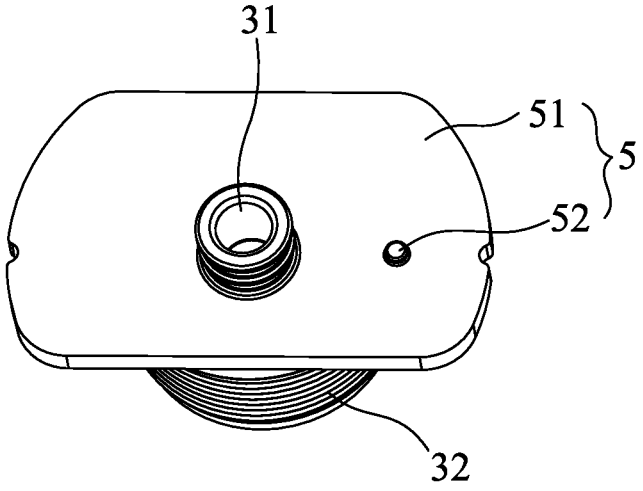
FIG. 6 is a rear perspective view showing the adapter of the present invention.

Referring to FIGS. 4 and 5, when the formed faucet inner core body 1 and the adapter 3 are assembling, the adapter 3 and the cooperating structure 5 are aimed at the two hooks 41 on the transverse pipe 13 by a lateral direction, and then the connecting portion 32 are combined with the water outlet 10 by a sealing unit. Then, the adapter 3 is rotated about the water outlet 10 as an axis to allow two front sides of the connecting plate of the cooperating structure 5 to be extended into respective hook recesses of the two hooks 41. When the fixing convex unit 52 is lodged in the recess 42, the assemblage of the adapter 3 and the dual-connected faucet inner core is completed to construct a water outlet structure which satisfies the demand for shapes of faucet housings.

Figure 7:
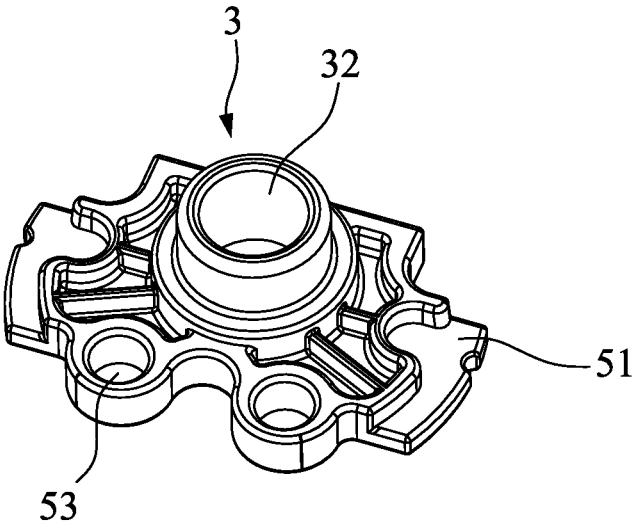
FIG. 7 is a schematic view showing the adapter of the present invention in another structure.
Figure 8:
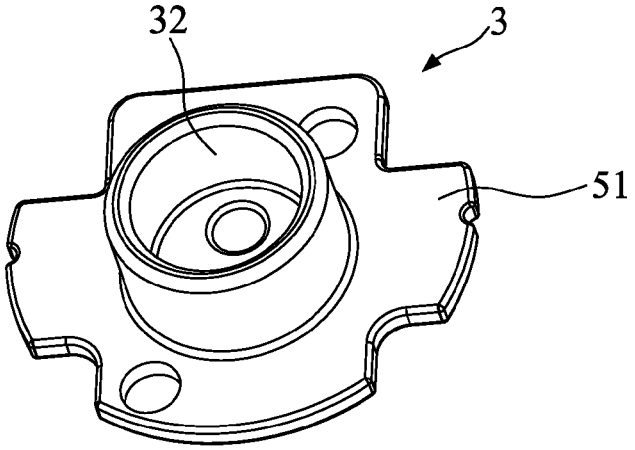
FIG. 8 is a schematic view showing the adapter of the present invention in another structure.
Figure 9:
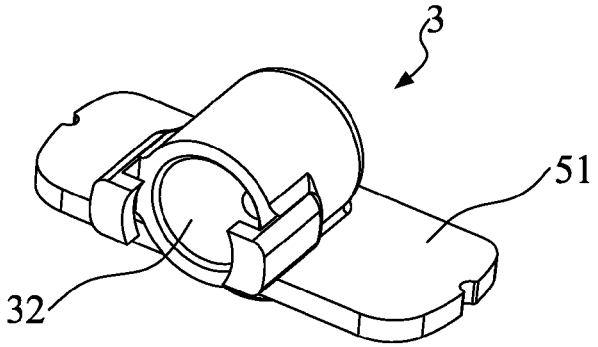
FIG. 9 is a schematic view showing the adapter of the present invention in another structure.

As referring to FIG. 7, in order to increase the combination between the assemblage of the adapter 3 and the faucet inner core body 1, a set of first locking holes 53 can be formed on the cooperating structure 5, and a set of second locking holes can be also formed on the corresponding transverse pipe 13. After the adapter 3 and the faucet inner core body 1 are assembled in place, a fastener can be used to fasten the adapter 3 with the faucet inner core body 1.

The adapter 3 can be set by various water outlet directions for meeting the demand for shapes of water outlet mouths of different faucet housings. As shown from FIGS. 7 to 9, the adapter always requires an arrangement of the cooperating structure 5 which fits in with the connecting structure 4. Accordingly, the adapter 3 with various variations can satisfy a variety of shapes of the faucet housings effectively. Because of the small volume of the adapter 3, the cost of the forming molds is low to largely decrease the cost in comparison with the cost of traditional technique incurred by shaping specific dual-connected faucet inner core according to different shapes of faucet housings.

To sum up, the water outlet structure of the dual-connected faucet inner core in accordance with the present invention takes advantage of the connecting structure 4 disposed beside the water outlet 10 of the faucet inner core body 1 to set the water outlet cooperating with the water outlet mouth of different faucet housing in various shapes into adapters 3 in different shapes and dispose the cooperating structure 5 connected to the connecting structure 4 on the adapter 3, whereby the adapter 3 and the faucet inner core body 1 are assembled to construct the double-faucet structure in a variety of shapes. The subject invention achieves a dual-connected faucet inner core body 1 in one shape to fit in with faucet housings in a variety of shapes by using different adapters 3, thereby lowering the manufacturing cost effectively and enhancing the market competitiveness of the product.

While we have shown and described the embodiment in accordance with the present invention, it should be clear to those skilled in the art that further embodiments and variations may be made without departing from the scope of the present invention.

What is claimed is:

1. A water outlet structure of a dual-connected faucet inner core comprising a faucet inner core body and multiple metal conduits integrally formed on two water inlet pipes of said faucet inner core body; wherein an adapter is disposed to be movably connected to a water outlet of said faucet inner core body, a water outlet portion being formed at a middle of said adapter and disposed correspondingly to a direction of a water outlet mouth of a faucet housing, a connecting portion which extends into said water outlet of said faucet inner core body being formed at an underside of said water outlet portion, a connecting structure being disposed beside said water outlet of said faucet inner core body for fitting in with said adapter, a cooperating structure which is connected to said connecting structure being disposed on said adapter, wherein said connecting structure is formed by two upward-protruding hooks which are symmetrically formed on two sides of said water outlet, said cooperating structure corresponding to said adapter being formed by a connecting plate that is formed on a top-side edge of said connecting portion of said adapter, a front width of said connecting plate being corresponding to a width between hook bottoms of said two hooks, a side width thereof being smaller than said width between said hook bottoms of said two hooks, a thickness of said connecting plate being smaller than a height from said hook bottoms to hook tops of said two hooks;

a recess is formed on a top surface of a transverse pipe at an inner side of one of said hooks or said two hooks, a fixing convex unit corresponding to said recess being formed on a bottom surface of said connecting plate.

2. The water outlet structure of the dual-connected faucet inner core as claimed in claim 1, wherein a set of first locking holes is formed on said cooperating structure, a set of second locking holes being formed on said corresponding transverse pipe, said adapter and said faucet inner core body being installed in place and fastened with each other by a fastener.

3. The water outlet structure of the dual-connected faucet inner core as claimed in claim 1, wherein said faucet inner core body is integrally formed by plastic, which comprises an H-shaped configuration formed by a cold water inlet pipe, a hot water inlet pipe and a transverse pipe communicating with said cold water inlet pipe and said hot water inlet pipe, said water outlet being disposed on said transverse pipe.

4. The water outlet structure of the dual-connected faucet inner core as claimed in claim 3, wherein the transverse pipe further comprises an inner-core transverse pipe disposed therein, said inner-core transverse pipe includes said water outlet mouth corresponding to said water outlet of said transverse pipe, two ends of said inner-core transverse pipe being defined by expanding portions that communicate with said cold water inlet pipe and said hot water inlet pipe respectively.

5. The water outlet structure of the dual-connected faucet inner core as claimed in claim 3, wherein said connecting structure is formed by two upward-protruding hooks which are symmetrically formed on two sides of said water outlet, said cooperating structure corresponding to said adapter being formed by a connecting plate that is formed on a top-side edge of said connecting portion of said adapter, a front width of said connecting plate being corresponding to a width between hook bottoms of said two hooks, a side width thereof being smaller than said width between said hook bottoms of said two hooks, a thickness of said connecting plate being smaller than a height from said hook bottoms to hook tops of said two hook.

6. The water outlet structure of the dual-connected faucet inner core as claimed in claim 5, wherein a recess is formed on a top surface of a transverse pipe at an inner side of one of said hooks or said two hooks, a fixing convex unit corresponding to said recess being formed on a bottom surface of said connecting plate.

7. The water outlet structure of the dual-connected faucet inner core as claimed in claim 5, wherein a set of first locking holes is formed on said cooperating structure, a set of second locking holes being formed on said corresponding transverse pipe, said adapter and said faucet inner core body being installed in place and fastened with each other by a fastener.

* * * * *